US009490567B2

(12) United States Patent
Hirakawa et al.

(10) Patent No.: US 9,490,567 B2
(45) Date of Patent: Nov. 8, 2016

(54) CONNECTOR

(71) Applicant: Yazaki Corporation, Tokyo (JP)

(72) Inventors: Takayoshi Hirakawa, Kakegawa (JP); Toshikazu Yoshioka, Kakegawa (JP); Atsunori Iwashita, Kakegawa (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/931,079

(22) Filed: Nov. 3, 2015

(65) Prior Publication Data

US 2016/0126657 A1 May 5, 2016

(30) Foreign Application Priority Data

Nov. 4, 2014 (JP) ..... 2014-224743

(51) Int. Cl.

| | |
|---|---|
| ***H01R 13/40*** | (2006.01) |
| ***H01R 13/42*** | (2006.01) |
| ***H01R 4/18*** | (2006.01) |
| ***H01R 13/04*** | (2006.01) |

(52) U.S. Cl.

CPC ..... *H01R 13/42* (2013.01); *H01R 4/184* (2013.01); *H01R 13/04* (2013.01)

(58) Field of Classification Search

CPC ..... H01R 13/04; H01R 13/40; H01R 13/42; H01R 4/184

USPC ..... 439/733.1, 692

See application file for complete search history.

(56) References Cited

U.S. PATENT DOCUMENTS

| | | | | |
|---|---|---|---|---|
| 6,113,436 | A | 9/2000 | Kuwahara et al. | |
| 8,545,275 | B2 * | 10/2013 | Wang | H01R 13/44 439/680 |
| 8,956,192 | B2 * | 2/2015 | Eckel | H01R 13/44 439/686 |
| 9,054,437 | B2 * | 6/2015 | Kojima | H01R 13/04 |

FOREIGN PATENT DOCUMENTS

| | | | |
|---|---|---|---|
| JP | 20003750 | A | 1/2000 |

* cited by examiner

*Primary Examiner* — Khiem Nguyen

(74) *Attorney, Agent, or Firm* — Sughrue Mion, PLLC

(57) ABSTRACT

A connector includes a housing, a terminal supported inside the housing and having a hollow cylindrical body and a wire connection portion provided on one side of the hollow cylindrical body, an insulating member inserted in the hollow cylindrical body and having, at a front end of the insulating member, a head portion protruding from a front end of the terminal, and a ring attached to a rear end portion of the insulating member protruding from a rear end of the hollow cylindrical body. An outer surface of the rear end portion of the insulating member has a stepped portion on which the ring abuts to restrict a movement of the insulating member in a direction towards the head portion.

5 Claims, 4 Drawing Sheets

CONNECTOR

CROSS-REFERENCE TO RELATED APPLICATIONS

The present application claims priority from Japanese Patent Application No. 2014-224743 filed on Nov. 4, 2014, the entire content of which is incorporated herein by reference.

FIELD OF INVENTION

The present invention relates to a connector, and more particularly, relates to a connector having a terminal to which an insulating member is attached.

RELATED ART

A plurality of electric devices is mounted on cars such as electric cars and hybrid cars, a plurality of electric wires for large current are connected to these electric devices via connectors. This kind of connector has a male connector that holds a rod-shaped male terminal in a male housing and a female connector that holds a cylindrical female terminal in a female housing. In the male connector, the female terminal is inserted in a gap between the male terminal and the male housing.

In this kind of male connector, for example, by placing the distal end of the male terminal behind (in the rear of) the distal end of the male housing, the male terminal is prevented from being touched by a finger inserted into the male housing. However, a connector to which electric wires for large current and the like are connected is comparatively large in size and the space inside the housing is large, so that a finger may contact the male terminal.

According to another related art, a connector is configured such that an insulating member is attached to the distal end of the male terminal to prevent a finger from contacting the male terminal. The insulating member has a shaft portion inserted into the hollow cylindrical male terminal and a large-diameter head portion formed at the end portion of the shaft portion, and is attached with the head portion protruding from the distal end of the male terminal. To hold the insulating member at the hollow cylindrical male terminal, portions of the hollow cylindrical body are bent inward to lock the shaft portion of the insulating member (see, e.g., JP2000-003750A)

However, in the related art, the male terminal is cut to bend the portions of the male terminal. Therefore, the cross-sectional area of the conductive path is reduced and the conductivity of the male terminal is lowered, deteriorating the conductivity reliability of the connector.

SUMMARY

Illustrative aspects of the present invention provide a connector in which an insulating member is held at a terminal without lowering conductivity of the terminal.

According to an illustrative aspect of the present invention, a connector includes a housing, a terminal supported inside the housing and having a hollow cylindrical body and a wire connection portion provided on one side of the hollow cylindrical body, an insulating member inserted in the hollow cylindrical body and having, at a front end of the insulating member, a head portion protruding from a front end of the terminal, and a ring attached to a rear end portion of the insulating member protruding from a rear end of the hollow cylindrical body. An outer surface of the rear end portion of the insulating member has a stepped portion on which the ring abuts to restrict a movement of the insulating member in a direction towards the head portion.

According to this configuration, the insulating member has its movement restricted by the ring being locked at the stepped portion of the insulating member protruding from the rear end of the hollow cylindrical body, and the head portion at the front end is held at the front end of the hollow cylindrical body of the terminal. Therefore, the insulating member can be held without the hollow cylindrical body of the terminal being cut to form a protrusion and as a result, reduction in the cross-sectional area of the conductive path of the male terminal can be avoided, so that the insulating member can be held in the male terminal without lowering the conductivity of the male terminal. The ring may be integrally formed, for example, of an elastic material that enables the ring to be attached to the insulating member or may have a split structure.

The ring may have a circular ring shape, may have a plurality of split ring parts configured such that the ring is split in a circumferential direction of the ring, and may be held inside the housing. According to this configuration, the work of attaching the ring to the insulating member is facilitated. Moreover, by forming the ring in a circular ring shape, even if an external force in the rotation direction acts on the ring due to a twisted electric wire when inserting the ring into the housing, the load at the time of the insertion can be reduced by rotating the ring in the housing.

Split surfaces of adjoining ones of the split ring parts may be configured to engage with each other. According to this configuration, an axial position shift between the split ring parts can be prevented, so that the strength of holding the insulating member can be enhanced.

The terminal may be configured such that the rear end of the hollow cylindrical body is held inside the housing via the ring. That is, an inner surface of the ring may be configured to contact the outer surface of the hollow cylindrical body of the male terminal, whereby the strength of holding the male terminal in the housing can be enhanced. This enables the male terminal to be held in a stable manner even if the male housing is compact.

The ring and the terminal may be rotatably supported inside the housing. According to this configuration, since the load on the part of connection between the terminal and the electric wire can be reduced by the rotation of the terminal even if an external force in the rotation direction acts from the electric wire on the terminal in a state of being supported in the housing, the electric wire can be prevented from being broken, so that the reliability of the connector can be enhanced.

DETAILED DESCRIPTION

Hereinafter, an exemplary embodiment of the present invention will be described with reference to the drawings.

A connector according to an exemplary embodiment of the present invention is used as a male connector of a connector that connects two large-current electric wires to each other, each large-current electric wire being connected to an associated electric device mounted on an electric car, a hybrid car or the like. However, the present invention is not limited to this example, and may be applied to various kinds of connectors that connect electric wires to each other.

Figure 1:
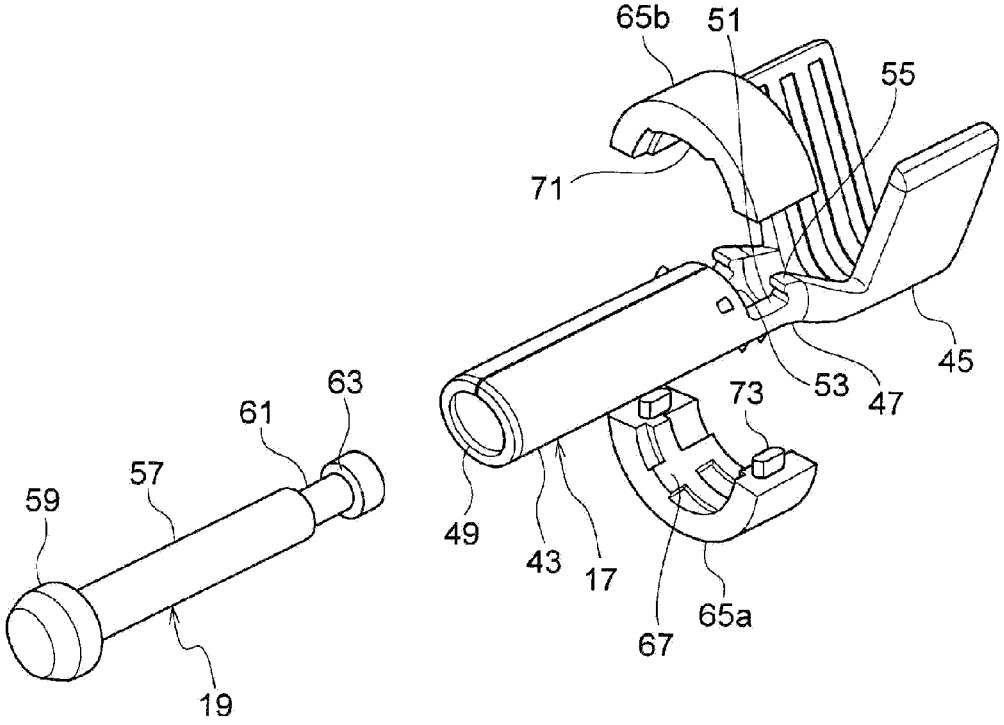
FIG. 1 is a longitudinal cross-sectional view of a connector according to an exemplary embodiment of the present invention.

FIG. 1 shows a longitudinal cross-sectional view of a male connector according to an exemplary embodiment of the present invention. The male connector 11 has a male housing 13 made of an insulating resin, a conductive shield shell 15, a plurality of male terminals 17 accommodated and held in the male housing 13, a plurality of insulating members 19 attached to the male terminals 17, respectively, and a plurality of split rings 21, each having a circular ring shape, attached to the respective insulating members 19. In FIG. 1, only one male terminal 17 is illustrated.

The male housing 13 has a cylindrical outer housing 23 and a cylindrical inner housing 25 arranged inside the outer housing 23. The shield shell 15 is provided in a gap between the outer housing 23 and the inner housing 25. The male housing 13 and the shield shell 15 are formed by integral molding. In the following, description will be given with the left side (counterpart terminal side) of FIG. 1 as the front side.

The outer housing 23 has at one end portion in the axial direction a front insertion opening 27 through which a female terminal (not shown) as the counterpart terminal is inserted, and has at the other end portion a rear insertion opening 31 through which a plurality of electric wires 29 connected to the male terminals 17, respectively, are inserted. In the rear insertion opening 31, a rubber packing 33 where insertion holes for the electric wires 29 are formed is fitted, so that the gap between the outer peripheral surfaces of the electric wires 29 and the inner peripheral surface of the outer housing 23 is sealed in a watertight manner. On the rear insertion opening 31 where the rubber packing 33 is fitted, a resin-made rear cover 35 where insertion holes for the electric wires 29 are formed is fitted to prevent the rubber packing 33 from slipping out and restrict the movement of the electric wires 29.

Both end portions of the inner housing 25 in the axial direction are disposed inside (depth side) of the outer housing 23, and a plurality of terminal accommodation chambers 37 that are open at both end portions in the axial direction are provided. In the terminal accommodation chamber 37, the split ring 21 can be accommodated in a cylindrical space. In this terminal accommodation chamber 37, a terminal support hole 39 circular in cross section is provided at the front end portion, and a terminal insertion hole 41 circular in cross section is provided at the rear end portion.

The terminal support hole 39 supports the male terminal 17. The inner diameter of the terminal support hole 39 is smaller than the outer diameter of the split ring 21. The inner diameter of the terminal insertion hole 41 is substantially the same as the outer diameter of the terminal accommodation chamber 37, and allows the split ring 21 to be inserted in the terminal insertion hole 41.

In the terminal accommodation chamber 37, an elastically deformable lance 42 is provided to extend inside the terminal accommodation chamber 37, and the split ring 21 inserted from the terminal insertion hole 41 is pressed against elastically deformable lance 42 so that the split ring 21 is held near the terminal support hole 39, preferably, in a state in which the split ring 21 abuts on the periphery edge of the terminal support hole 39.

Figure 2:
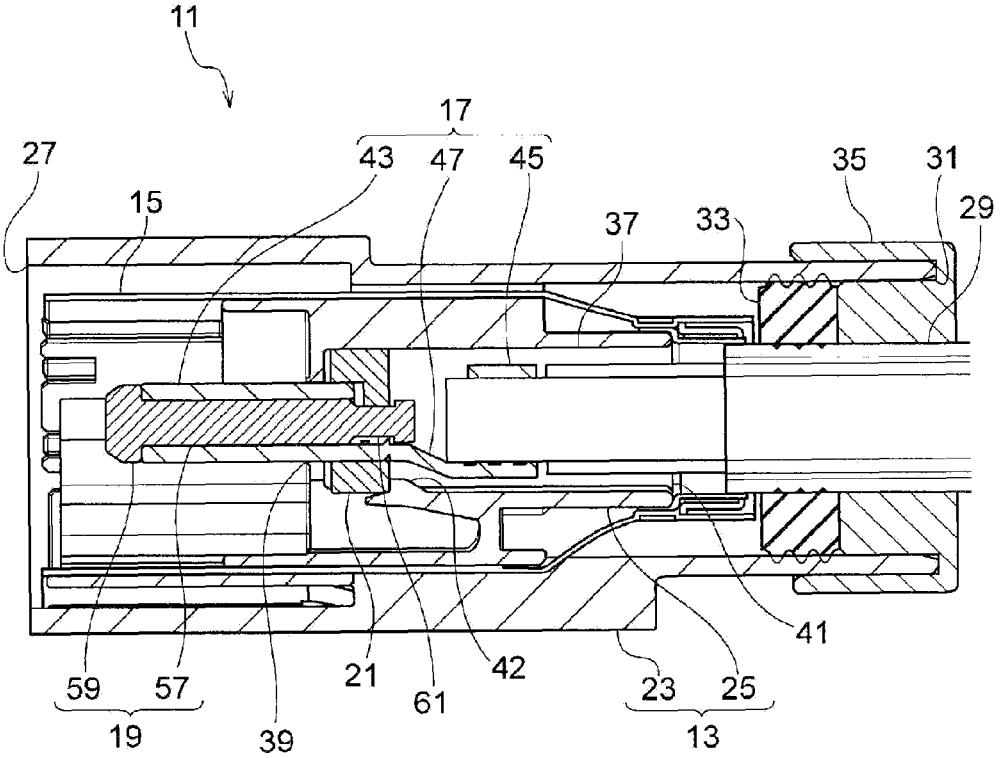
FIG. 2 is an exploded perspective view of a male terminal, an insulating member and a split ring of the connector.
Figure 3:
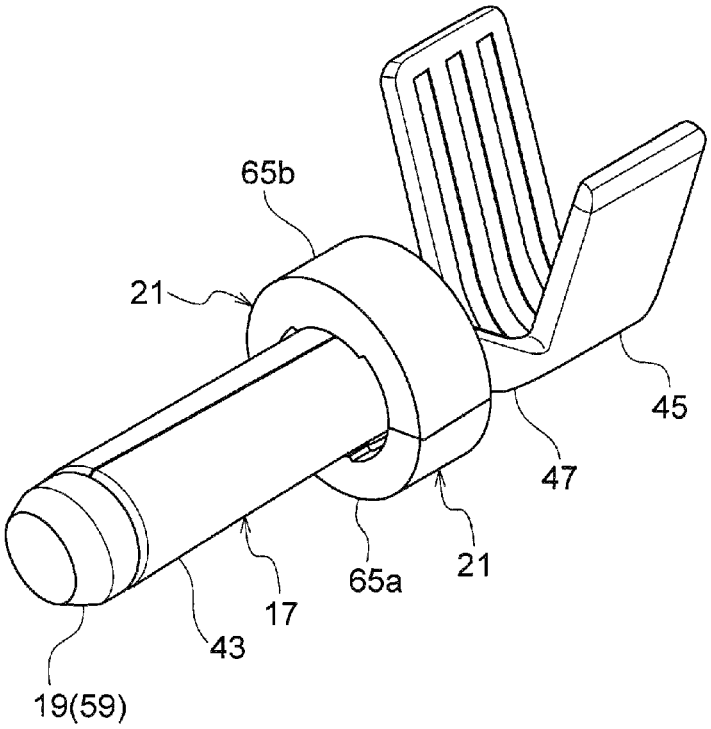
FIG. 3 is an external perspective view of FIG. 2 after assembly.

Next, the structure of the male terminal 17 will be described. As shown in FIGS. 2 and 3, the male terminal 17 is formed of a hollow cylindrical body 43, a pair of wire connection portions 45 formed at one end side of the hollow cylindrical body 43, and an intermediate portion 47 connecting the hollow cylindrical body 43 and the wire connection portions 45. This male terminal 17 is formed by stamping a flat metal plate material.

The hollow cylindrical body 43 is formed in a shape of a hollow cylinder and has an insulating member insertion opening 49 at a front end of the hollow cylindrical body 43. The hollow cylindrical body is relatively inserted in the cylindrical female terminal.

The intermediate portion 47 is opened upward, and is arc-shaped in cross-section. An upper end surface 51 of each of the right and left walls of the intermediate portion 47 is sandwiched between a hollow cylindrical rear end surface 53 ranging on the front side and a protruding portion 55 ranging on the rear side, and is formed in the shape of a groove. The right and left upper end surfaces are flat surfaces parallel to each other.

The pair of wire connection portions 45 each range from the upper end surface of the protruding portion 55 in a tapered form and extend upward in a V shape. These wire connection portions 45 are folded in such a manner as to wrap the conductor terminal of the electric wire 29 to pressedly fix the electric wire 29 to the male terminal 17.

The insulating member 19 is formed by molding an insulating resin, and attached to the male terminal 17. This insulating member 19 has, as shown in FIG. 2, a cylindrical shaft portion 57 inserted in the hollow cylindrical body 43 of the male terminal 17 and a head portion 59 provided at the front end of the shaft portion 57.

The shaft portion 57 has a groove portion 61 with a diameter smaller than the outer diameter of the shaft portion 57 on the outer surface at the rear end portion thereof. The groove portion 61 is rectangle in cross section and formed over the entire periphery of the shaft portion 57, and in a rear part in the groove portion 61, a stepped portion 63 is formed that is orthogonal to the axial direction and formed on the boundary between the bottom of the groove portion 61 and the outermost peripheral surface of the shaft portion 57.

The head portion 59 has a truncated cone shape, and is larger than the inner diameter of the hollow cylindrical body 43 of the male terminal 17. In the present exemplary embodiment, the maximum outer diameter of the head portion 59 is substantially the same as the outer diameter of the hollow cylindrical body 43.

Figure 4:
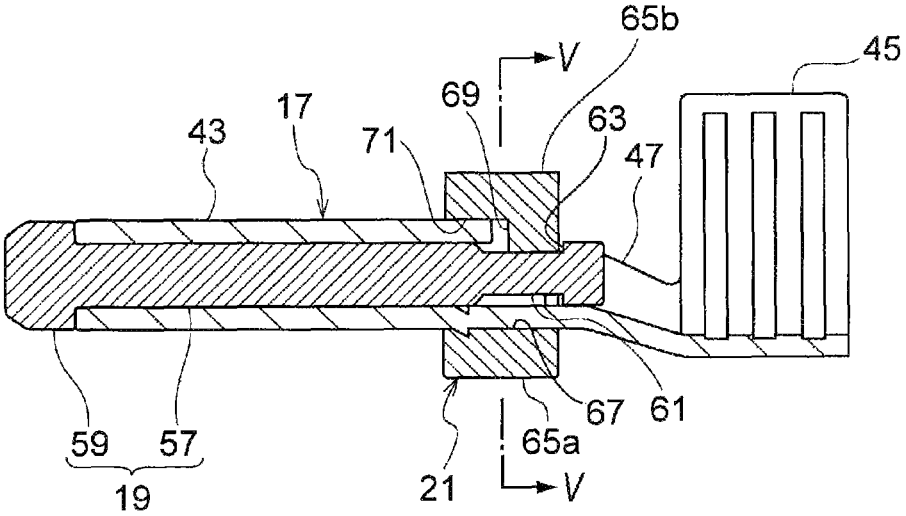
FIG. 4 is a lateral cross-sectional view of FIG. 3.

Therefore, as shown in FIGS. 3 and 4, the insulating member 19 attached to the male terminal 17 is provided in such a manner that the head portion 59 abuts on the front end surface of the hollow cylindrical body 43 and protrudes forward from the front end surface thereof with the shaft portion 57 being inserted in the hollow cylindrical body 43 of the male terminal 17.

The split ring 21 has two arc-shaped split ring parts 65*a*, 65*b*, that is, divided in halves the circumferential direction, and is attached to the male terminal 17. This split ring 21 has, when viewed from the axial direction, an outer surface of a perfect circle and has a through hole formed in the center thereof. The split ring 21 may be split into three or more, and the outer surface thereof may be angular.

Figure 5:
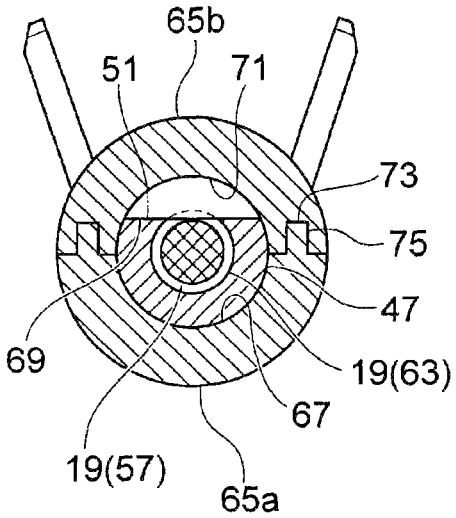
FIG. 5 is a cross-sectional view taken on the line V-V of FIG. 4.

As shown in FIGS. 4 and 5, an inner surface 67 of one split ring part 65*a* is formed in an arc shape to contact the arc-shaped outer surface of the male terminal 17 along the circumferential direction. The other split ring part 65*b* has a locking wall 69 inwardly protruding from a rear portion of the inner surface of the split ring part 65*b* in a shape of a portion of a semicircle, and the inner surface 71 in front of the locking wall 69 is formed in an arc shape. The axial thickness of the locking wall 69 is smaller than the entire axial length of the split ring part 65*b* such that the locking wall 69 can contact the upper end surface 51 of the intermediate portion 47 of the male terminal 17, and is formed flush with the rear end surface of the split ring part 65*a*. That is, the other split ring part 65*b* is formed so that the locking wall 69 is inserted in the groove portion 57 of the insulating member 19 attached to the male terminal 17 and the arc-shaped inner surface 71 at the front abuts on the outer peripheral surface of the hollow cylindrical body 43 of the male terminal 17 in the circumferential direction.

As shown in FIG. 5, on each split surface of one split ring part 65*a* of the split ring 21, a protrusion 73 protruding from the split surface is provided, and on each split surface of the other split ring part 65*b* of the split ring 21, a recess 75 where the protrusion 73 is engaged is provided. Thus, the split ring 21 is prevented from being displaced by the protrusion 73 of one split ring part 65*a* being inserted in the recess 75 of the other split ring part 65*b* so that the split surfaces abut on each other and the split ring parts 65 are engaged together. As the engagement structure of the split ring parts 65, a configuration other than a concave and a convex may be adopted.

Next, an example of a method of assembling the male connector 11 will be described.

First, the male terminal 17 to which the electric wire 29 is connected, the insulating member 19 and the split ring 21 are prepared. Then, the shaft portion 57 of the insulating member 19 is inserted from the insertion opening 49 of the male terminal 17. As shown in FIG. 4, the insulating member 19 inserted in the male terminal 17 is disposed in such a manner that the head portion 59 abuts the front end of the hollow cylindrical body 43 of the male 10 terminal 17 and protrudes forward. At this time, the rear end portion of the insulating member 19 protrudes from the rear end of the hollow cylindrical body 43, so that the groove portion 61 is exposed to the outside.

Then, the split ring 21 is attached to the male terminal 17. At this time, the split ring 21 is attached in such a manner that the locking wall 69 of the other split ring part 65*b* abuts on the right and left upper end surfaces 51 of the male terminal 17 while the protrusion 73 and the recess 75 are engaged together. Consequently, the locking wall 69 of the split ring 21 is inserted in the groove portion 61 of the insulating member 19 and the inner surface thereof at the front abuts on the outer peripheral surface of the rear end portion of the hollow cylindrical body 43 in the circumferential direction.

The split ring 21 has its axial movement restricted with respect to the male terminal 17 since the locking wall 69 of the split ring part 65*b* is engaged between the rear end surface 53 of the hollow cylindrical body 43 and the stepped portion 63 of the groove portion 61 of the insulating member 19 and this locking wall 69 is further engaged between the hollow cylindrical rear end surface 53 and the protruding portion 55 of the male terminal 17. Moreover, the insulating member 19 is held in the male terminal 17 by its movement toward the head portion 59 being restricted by the stepped portion 63 of the groove portion 61 abutting on the locking wall 69 of the split ring 21 to be hooked thereon. Consequently, the axial movements of the male terminal 17, the insulating member 19 and the split ring 21 are restricted by one another.

Then, the insulating member 19 and the split ring 21 are attached, and the male terminal 17 to which the electric wire 29 is connected is inserted into the terminal accommodation chamber 37 of the male housing 13. This male terminal 17 is inserted from behind the male housing 13, that is, from the terminal insertion hole 41 of the inner housing 25. When the male terminal 17 is inserted in the terminal accommodation chamber 37, subsequently thereto, the split ring 21 attached to the male terminal 17 is inserted into the terminal accommodation chamber 37.

The split ring 21 inserted in the terminal accommodation chamber 37 slides in the terminal accommodation chamber 37 together with the male terminal 17 and climbs over the lance 42 to be held in a set position in the terminal accommodation chamber 37. That is, the split ring 21 has its axial movement restricted by the male housing 13. Consequently, the male terminal 17 is held in the male housing 13 through the insulating member 19 hooked on the split ring 21, and is supported by the terminal support hole 39 by the hollow cylindrical body 43 being inserted in the terminal support hole 39 (FIG. 1).

On the other hand, the electric wire 29 is drawn out rearward from the terminal insertion hole 41 of the terminal accommodation chamber 37. To the electric wire 29, the rubber packing 33 and the rear cover 35 are attached. The rubber packing 33 is fitted in the rear insertion opening 31 of the outer housing 23 and then, the rear cover 35 is fitted and fixed 15 to the rear insertion opening 31, whereby the rear insertion opening 31 is sealed.

Moreover, under this condition, the split ring 21 is rotatably supported in the terminal accommodation chamber 37, and the male terminal 17 also rotates together with the split ring 21. That is, the male terminal 17 and the split ring 21 are supported rotatably with respect to the male housing 13. Consequently, since the load on the portion of connection between the male terminal 17 and the electric wire 29 can be reduced by the rotation of the male terminal 17 and the split ring 21 even if an external force in the rotation direction acts on the male terminal 17 from the electric wire 29, the electric wires 29 can be prevented from being broken, so that the reliability of the connector can be enhanced.

As described above, in the present exemplary embodiment, since the movement of the insulating member 19 in the direction toward the head portion 59 is restricted by the split ring 21 being hooked on the rear end portion (the stepped portion 63) of the insulating member 19 protruding rearward from the hollow cylindrical body 43 of the male terminal 17, for example, unlike in the structure where the rear end portion of the insulating member 19 is thermally welded to the male terminal 17 to hold the insulating member 19, the insulating member 19 is not deformed, so that the area where the insulating member 19 is hooked is stabilized. This stabilizes the strength of holding the insulating member 19, so that the insulating member 19 can be reliably prevented from slipping out of the male terminal 17. Therefore, when a finger or the like is inserted into the male housing 13, even if the finger touches the head portion 59 of the insulating member 19, the male terminal 17 (the hollow cylindrical body 43) situated in the rear thereof can be prevented from being touched by the finger.

Moreover, according to the present exemplary embodiment, since it is unnecessary to provide a notch, a hole or the like on the male terminal 17 in order to hold the insulating member 19 in the male terminal 17, reduction in the cross-sectional area of the conductive path of the male terminal 17 is avoided, so that reduction in the conduction performance can be prevented. Consequently, a connector suitable for passing large current can be provided.

Moreover, in the present exemplary embodiment, since the two split ring parts 65*a*, 65*b* constituting the split ring 21 are engageable with each other, the positions of the split ring parts 65*a*, 65*b* are never shifted from each other in the axial direction in the terminal accommodation chamber 37. Consequently, the strength of holding the insulating member 19 is further stabilized.

Moreover, according to the exemplary embodiment described above, since the split ring 21 has a circular ring shape, a degree of freedom is provided to the position in the rotation direction at the time of insertion. Therefore, for example, when an external force in the rotation direction acts on the male terminal 17 due to twist of the electric wire 29 or the like, since the split ring 21 can be inserted into the male housing 13 while being rotated, the load when the male terminal 17 is inserted into the male housing 13 against the external force of the electric wire 29 can be reduced, so that work efficiency improves. In addition, by forming the split ring 21 to have a circular ring shape, damage to the split ring 21 and the male housing 13 at the time of insertion can be suppressed.

Moreover, in the present exemplary embodiment, not only the hollow cylindrical body 43 of the male terminal 17 is supported by the terminal support hole 39 of the inner housing 25 but also the rear end portion of the hollow cylindrical body 43 is held in the male housing 13 through the split ring 21. That is, the male terminal 17 is supported at two positions in the axial direction. Consequently, for example, even if the thickness of the terminal support hole 39 is short, the male terminal 17 can be supported in the male housing 13, so that the male connector can be reduced in length.

While the present invention has been described with reference to a certain exemplary embodiment thereof, the scope of the present invention is not limited to the exemplary embodiment described above, and it will be understood by those skilled in the art that various changes and modifications may be made therein without departing from the scope of the present invention as defined by the appended claims.

For example, the shape of the hollow cylindrical body 43 of the male terminal 17 is not limited to a cylinder but may be a square pillar. In such a case, the inner surface of the split ring 21 has a shape that corresponds to the outer shape of the hollow cylindrical body 43.

Moreover, while in the present exemplary embodiment, the stepped portion 63 on which the split ring 21 abuts is provided on the groove portion 61 formed on the shaft portion 57 of the insulating member 19, the stepped portion 63 is not limited to the case of the groove portion 61 as long as the split ring 21 abuts thereon to restrict the movement of the insulating member 19 in the direction toward the head portion 59. That is, the stepped portion may be provided in the concave where the protrusion protruding from the inner surface of the split ring 21 engages or may be formed by D-cutting part of the outer peripheral surface of the shaft portion 57 in a shape that is semilunar in cross section.

Moreover, while in the present exemplary embodiment, the locking wall 69 of the split ring 21 is sandwiched between the rear end surface 53 and the protruding portion 55 of the hollow cylindrical body 43 of the male terminal 17 to thereby restrict the axial positions of the split ring 21 and the male terminal 17 relative to each other, even if this structure is absent, the axial position of the male terminal 17 can be restricted by the insulating member 19 being hooked on the split ring 21. Moreover, for example, the axial position of the male terminal 17 can also be restricted by providing a protrusion engaging with the inner peripheral surface of the split ring 21 on the outer peripheral surface of the male terminal 17.

Moreover, while the split ring 21 is hooked on the insulating member 19 in the exemplary embodiment described above, an integrally formed ring may be provided instead of the split ring 21. In such a case, the ring is made of an elastic material (e.g., elastomer) so that the ring is fitted in the groove portion 61 of the insulating member 19.

What is claimed is:

1. A connector comprising:

a housing;

a terminal supported inside the housing, the terminal having a hollow cylindrical body and a wire connection portion provided on one side of the hollow cylindrical body;

an insulating member inserted in the hollow cylindrical body, the insulating member having, at a front end of the insulating member, a head portion protruding from a front end of the terminal; and a ring attached to a rear end portion of the insulating member protruding from a rear end of the hollow cylindrical body, wherein an outer surface of the rear end portion of the insulating member has a stepped portion on which the ring abuts to restrict a movement of the insulating member in a direction towards the head portion.

2. The connector according to claim 1, wherein the ring has a circular ring shape, the ring has a plurality of split ring parts configured such that the ring is split in a circumferential direction of the ring, and the ring is held inside the housing.

3. The connector according to claim 2, wherein split surfaces of adjoining ones of the split ring parts are configured to engage with each other.

4. The connector according to claim 1, wherein the terminal is configured such that the rear end of the hollow cylindrical body is held inside the housing via the ring.

5. The connector according to claim 1, wherein the ring and the terminal are rotatably supported inside the housing.

* * * * *